US010323489B2

(12) United States Patent
Harmat

(10) Patent No.: US 10,323,489 B2
(45) Date of Patent: Jun. 18, 2019

(54) APPARATUS AND METHODS FOR TREATING A WELLBORE SCREEN

(71) Applicant: ABSOLUTE COMPLETION TECHNOLOGIES LTD., Calgary (CA)

(72) Inventor: Fred Harmat, Edmonton (CA)

(73) Assignee: SCHLUMBERGER CANADA LIMITED, Calgary (CA)

( * ) Notice: Subject to any disclaimer, the term of this patent is extended or adjusted under 35 U.S.C. 154(b) by 39 days.

(21) Appl. No.: 15/316,354

(22) PCT Filed: Jun. 2, 2015

(86) PCT No.: PCT/CA2015/050514
§ 371 (c)(1),
(2) Date: Dec. 5, 2016

(87) PCT Pub. No.: WO2015/184548
PCT Pub. Date: Dec. 10, 2015

(65) Prior Publication Data

US 2017/0191352 A1 Jul. 6, 2017

Related U.S. Application Data

(60) Provisional application No. 62/007,551, filed on Jun. 4, 2014.

(51) Int. Cl.

| | |
|---|---|
| ***E21B 43/08*** | (2006.01) |
| ***B05D 1/28*** | (2006.01) |
| ***B05C 1/08*** | (2006.01) |

(52) U.S. Cl.
CPC ..... *E21B 43/08* (2013.01); *B05C 1/08* (2013.01); *B05D 1/28* (2013.01)

(58) Field of Classification Search
USPC ..... 118/325, 307, 420, DIG. 11, 302, 101, 118/110, 118, 58; 427/244, 256
See application file for complete search history.

(56) References Cited

U.S. PATENT DOCUMENTS 3,575,353 A * 4/1971 Sullivan ..... B28B 19/0038 239/314
4,490,411 A * 12/1984 Feder ..... C23C 24/10 118/306
5,585,143 A * 12/1996 Scharf ..... B05B 9/002 427/224

(Continued)

FOREIGN PATENT DOCUMENTS

WO WO 2013/120197 A1 8/2013

*Primary Examiner* — Yewebdar T Tadesse
(74) *Attorney, Agent, or Firm* — Bennett Jones LLP

(57) ABSTRACT

An apparatus and methods for applying an outer coating to a wellbore screen are described. The apparatus comprises a support for the wellbore screen, an injector for injecting coating material on to the outer surface of the wellbore screen, and a mechanism for positioning and moving the screen relative to the injector and/or moving the injector axially relative to the screen to introduce coating material to the outer surface of the screen. The apparatus further comprises rollers for distributing the coating material over the outer surface of the screen. The elongate injector has a coating material delivery line extending through the injector from a coating material supply to an open tip.

40 Claims, 4 Drawing Sheets

(56) References Cited

U.S. PATENT DOCUMENTS

| | | | | |
|---|---|---|---|---|
| 6,328,798 | B1 * | 12/2001 | Bostrom | B01F 7/022 118/303 |
| 6,742,586 | B2 | 6/2004 | Lauritzen et al. | |
| 2011/0042069 | A1 | 2/2011 | Bailey et al. | |
| 2012/0145389 | A1 | 6/2012 | Fitzpatrick, Jr. | |
| 2014/0295100 | A1 * | 10/2014 | Baskerville | H05B 6/36 427/543 |

* cited by examiner

APPARATUS AND METHODS FOR TREATING A WELLBORE SCREEN

FIELD

The invention relates to an apparatus and methods for treating wellbore screens. In particular, the invention relates to an apparatus and methods for applying a coating to a wellbore screen.

BACKGROUND

Various wellbore tubulars are known and serve various purposes. A wellbore screen is a tubular including a screen material forming or mounted in the tubular's wall. The wellbore screen can be used in wellbores such as those for water, steam injection and/or petroleum product production.

In one form, a wellbore screen is known that includes a wall of screen material held between end fittings. The wall includes screen material that may take various forms and is usually supported in some way, as by a perforated sleeve. These screens filter fluids passing through the screen material layer either into or out of the screen inner diameter.

In another form, a wellbore screen is an apparatus that can include a base pipe and a plurality of filter cartridges supported in the base pipe. The filter cartridges are mounted in openings through the base pipe wall. The filter cartridges screen fluids passing through the openings into the base pipe for pumping or flow up hole. Of course, the openings may be formed and/or employed to also permit flow of fluids outwardly therethrough from the inner diameter of the base pipe.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

SUMMARY OF THE INVENTION

In accordance with a broad aspect of the present invention, there is provided an apparatus for treating a wellbore screen with a coating material, the apparatus comprising: a support for supporting an outer tubular wall of the wellbore screen; a support frame; an injector for injecting coating material on to the outer tubular wall of the wellbore screen; a coating material delivery line extending through the injector from a coating material supply to an injection tip positioned near the support frame; and a driver for positioning the wellbore screen relative to the support frame and injection tip, and for moving the screen axially along the support frame to allow the injector to distribute coating material on to the outer tubular wall of the wellbore screen via the injection tip.

In accordance with another broad aspect of the present invention, there is provided a method for treating a wellbore screen having a tubular wall with an outer tubular surface and a screening component installed to screen fluid passing through the tubular wall from the outer tubular surface to the inner bore, the method comprising: supporting at least a portion of the wellbore screen on a support frame; introducing a coating material in the form of a liquid on to the outer tubular surface via an injection tip of an injector; distributing the coating material on to the outer tubular surface such that the coating material penetrates to some extent into the screening component; and allowing the coating material to set to form a removable seal across the screening component in the outer diameter.

In accordance with yet another broad aspect of the present invention, there is provided an apparatus for treating a wellbore screen with a coating material, the apparatus comprising: a support for supporting an outer tubular wall of the wellbore screen; an injector for injecting coating material on to the outer tubular wall of the wellbore screen via an injection tip positioned near the support; a coating material delivery line extending through the injector from a coating material supply to the injection tip; and a driving mechanism for moving the injection tip axially relative to the support in a direction substantially parallel to a lengthwise axis of the support, to allow the injector to distribute coating material on to the outer tubular wall of the wellbore screen via the injection tip.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which.

DETAILED DESCRIPTION OF VARIOUS EMBODIMENTS

Figure 1:
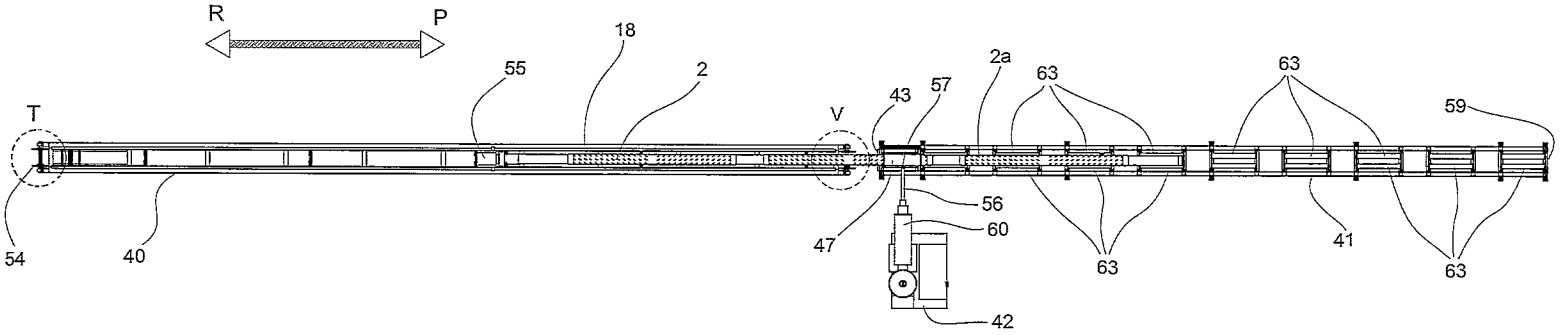
FIG. 1 is a top elevation view of an apparatus in a mid process position for applying a coating material to the outer diameter of a wellbore tubular.
Figure 2:
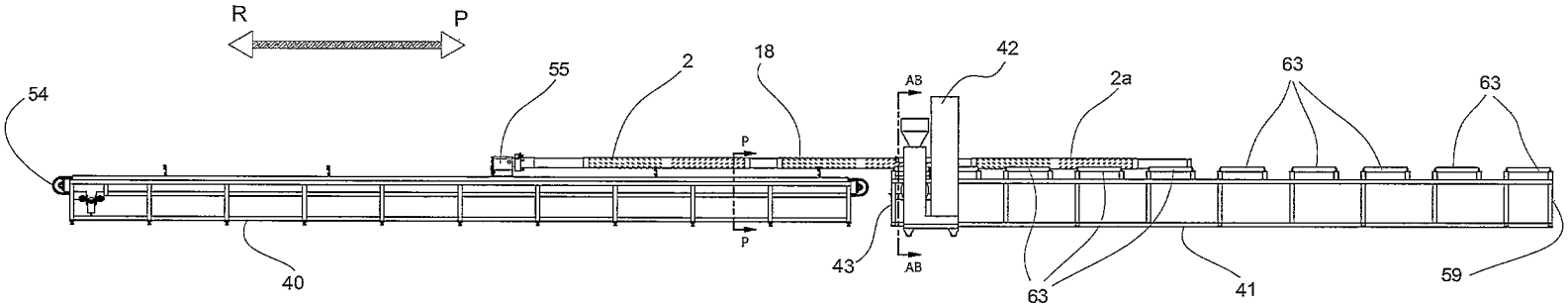
FIG. 2 is a side view of the apparatus in FIG. 1.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Referring to FIGS. 1 to 5, an apparatus is shown and a method is described for applying a coating material to a wellbore screen. The apparatus and method can be employed to form a wellbore screen with a coating.

In one embodiment, the wellbore screen 2 includes a tubular wall including an inner tubular surface defining an inner bore, an outer tubular surface and a screening component installed to screen fluid passing through the tubular wall from the outer tubular surface to the inner bore; and a coating on the outer tubular surface embedded into the screening component from the outer tubular surface, the coating substantially sealing against fluid passage through the screening component until the coating is at least partially removed.

The wellbore screen may be produced by a method comprising: providing a wellbore screen including a tubular wall with an inner tubular surface defining an inner bore, an outer tubular surface and a screening component installed to screen fluid passing through the tubular wall from the outer tubular surface to the inner bore; introducing a coating material in the form of a liquid on to the outer tubular surface; distributing the coating material on to the outer tubular surface such that it penetrates to some extent into the screening component; and allowing the coating material to set to form a removable seal across the screening component in the outer diameter.

The word "liquid" as used herein includes liquid, semi-fluid, and colloid. A semifluid is a substance with flow properties that are between those of solids and liquids.

The coating material is in the form of a liquid so that it can be distributed, such as for example by spreading, on the outer wall. In one embodiment, the viscosity of the liquid can be selected such that it tends not to rapidly migrate once introduced to the screen. For example, if the liquid has a low viscosity it may pour into or out of the tubular through the screening component as it is introduced. However, the viscosity of the liquid coating material can be selected such that the material introduced can be distributed on to the surface of the outer wall of the screen and can penetrate to some extent into the screening component, but is sufficiently viscous such that it remains in place once distributed. As will be appreciated, this ability to reliably place the coating material may also be achieved by selecting a liquid that rapidly moves through a phase change from liquid to solid when a temperature difference is encountered.

In this invention, the coating material may take various forms provided it can be handled in a liquid state and will set to a substantially solid form capable of creating a removable seal across the screening component. The coating material should have a repeatable phase change between solid and liquid such that it can be brought to a liquid state and will set to a solid state under predictable conditions of time and temperature. When in place and set in the wellbore screen, the coating material creates a substantial seal against fluid flow through the screening component, such that the screen acts as a tubular capable of holding pressures greater than would be otherwise possible if the coating material was not in place in the screening component. However, the coating material is removable to open the screening component to fluid flow therethrough. The coating material may be a polymer, a resin, a salt, a wax, or a combination thereof, etc. and may be removable by various means such as chemical breakdown, dissolution, solubilization, melting, etc. For example, the coating material may be a polymer removed by acid treatment, it may be a salt removed by solubilization in a liquid such as water, it may be wax removed by melting, etc.

In one embodiment, the coating material may be a wax such as paraffin wax. One useful wax has a repeatable phase change from solid to liquid between 50 to 90° C., such as a phase change from solid at 55° C. to 85° C. This wax also exhibits an extrudable and spreadable viscosity (i.e. of about 1000 to 1000000 centipoises) at a temperature of 65 to 75° C. When wax melts it is miscible in oil and wax can be removed from the surface of the wellbore screen, including the screening component, leaving substantially no residue. The crystalline structure, if any, of wax in the melted form is small enough to pass through a typical wellbore screening component without clogging, but forms a solid of substantial strength such that a pressure holding structure can be formed by infiltration of the wax into the screening component.

Depending on the coating material, the properties of the coating material may have to be adjusted to ensure the viscosity is appropriate. For example, the coating material may have to be heated before being introduced to the outer diameter or before being distributed. Alternately, or in addition, the method may include heating the wellbore screen before introducing the coating material to the outer diameter so that the coating material remains liquid once it contacts the material of the wellbore screen. The method may further include cooling and/or removing heat from the wellbore screen to facilitate the setting of the coating material.

Spreading or spraying the coating material on to the outer wall ensures that a substantially uniform coating is applied to the outer wall and the coating material penetrates into the screening material to some degree. The spreading procedure may also be configured to remove excess coating material from the outer diameter.

The method may include rotating the screen until the coating material is allowed to set. The screen may be rotated, for example, about its long axis to prevent the coating material from migrating by gravity to a low spot while it remains a liquid, until the coating material sets. Alternatively or additionally, the method may include rotationally spraying the coating material about the screen's long axis on to the outer wall.

The method can be carried out in various ways and by employing various apparatus. One possible apparatus is shown in FIGS. 1 to 5.

The illustrated apparatus includes a support frame 40 for the wellbore screen 2, the support 40 supporting an outer surface of the wellbore screen and presenting the wellbore screen with open access to its outer tubular wall 18; an injector 42 for injecting coating material on to the outer diameter of the wellbore screen; a coating material delivery line 56 extending through the injector 42 from a coating material supply 58 to an injection tip 57 positioned near a support frame 41 and a driver 54 for positioning the wellbore screen relative to frame 41 and moving the screen axially along frame 41 to allow injector 42 to distribute coating material on to the outer tubular wall of the wellbore screen. In the sample illustrated embodiment, the injector is positioned laterally beside a lengthwise side of support frame 41.

In one embodiment, the driver 54 operates to drive the wellbore screen relative to the injector to position the injection tip adjacent the outer diameter and move the screen relative to the injection tip along the outer tubular surface to allow coating material to be introduced from the injector to the outer diameter along the length of the screen.

In one embodiment, for example, the driver 54 is incorporated with the screen support 40 and together they form a driving base on which the screen is supported and along which the screen can be moved substantially in line with the screen's long axis. In this way, the screen can be moved along a drive axis in a forward direction (as illustrated by an arrow P) and in a reverse direction (as illustrated by an arrow R) while the inner bore remains substantially concentric with the drive axis.

In a further embodiment, the driver 54 includes a drive mechanism, such as a chain or belt drive. In the illustrated embodiment, the drive mechanism comprises a motor 51, a pair of chains 52, and two pairs of sprockets 53. One pair of sprockets 53 is positioned at or near one end of the screen support, while the other pair of sprockets is positioned at or near the other end of the screen support. Each sprocket is connected to the screen support near a lengthwise side of the screen support, and a face of the sprocket is substantially parallel to a face of the other sprocket in the pair. Each sprocket is connected to the driving in such a manner that allows the sprocket to rotate about its central axis, for example by extending an axle through an aperture on the lengthwise side of the screen support and through the central axis of the sprocket. Bearings may be disposed at the interface between the axle and the aperture, or between the axle and the sprocket, to allow the sprocket to rotate relative to the side of the screen support. In a further embodiment, the axle extends through both sprockets and both sides of the screen support at at least one end of the screen support. Of course, there may be other methods of rotatably connecting the sprockets to the screen support.

The motor 51 is configured to control the rotation of at least one pair of sprockets. In the illustrated embodiment, motor 51 is disposed near one pair of sprockets at one end of the screen support. A second motor may be disposed at the other end of the screen support, and each motor can operate independently and/or simultaneously, and each can be selectively utilized. Motor 51 may be directly connected to the axle(s) of the at least one pair of sprockets for rotating same. Motor 51 may be positioned in between the sprockets but not necessarily, as long as the motor is capable of controlling the rotation movement of the sprockets from wherever the motor is positioned. Motor 51 may be controlled locally or remotely. Motor 51 may also include a variable speed control and/or rotation direction control.

The distance between each pair of sprockets is preferably substantially the same as that of the other pair. Each of the chains 52 is meshed with one of the sprockets at each end of the screen support, such that the chains are substantially parallel to each other. The chains 52 preferably span across substantially the entire length of the screen support. The chains 52 are meshed with the sprockets 53, such that when at least one pair of sprockets is rotated, the chains 52 move relative to the screen support in line with the long axis of the screen support. In another embodiment, a belt may be used instead of chains 52. The belt has a width that is sufficient to span across and to mesh with each pair of sprockets at each end of the screen support. Alternatively, a single sprocket having a width substantially the same as that of the belt may replace the pair of sprockets at each end of the screen support.

The drive mechanism includes a fitting 55 is for engaging an end of the screen, for example, by threading to the threaded pin or box end of the screen. The use of threaded ends, as will be appreciated, is typical of a wellbore tubular such as a screen. In an alternative embodiment, the fitting includes a chuck, such as a scroll chuck, for engaging an end of the screen. The fitting 55 is connected to the drive mechanism in order to transfer the motion of the drive mechanism to the screen. In one embodiment, fitting 55 is connected to a section of the chains 52, so that when the chains move as a result of the rotation of the sprockets, fitting 55 moves with the chains. The drive mechanism is thereby capable of driving the engaged screen axially along the drive axis in both the forward direction P and reverse direction R, by switching the direction of the motor (if there is only one motor) or by alternating the operation of the motors (if there are two motors). The fitting may be attached to the chains in various ways, including for example by fasteners, adhesives, bonding, welding, etc. The fitting maybe removably attached to the chains such that the fitting may be interchanged for accommodating screens of various sizes and/or for the purpose of repairs and maintenance.

The fitting 55 may also include a mechanism for rotating the screen about its long axis. For example, the fitting may engage the screen to drive it axially along the drive axis and have a pipe rotator component to drive the screen rotationally about the screen's long axis. In one embodiment, the rotator component is a motor; however, other similar mechanisms may be used as well. The rotator component may include a variable speed control and/or rotation direction control.

The drive mechanism also includes a plurality of rollers 50 on which the screen can be supported. The rollers may support any movement of the screen relative to the screen support, whether axially or rotationally. The rollers 50 are attached to chains 52 and may be positioned intermittently or continuously along chains 52. In the illustrated embodiment, the rollers are carried on roller supports which are attached to chains 52 at substantially equally spaced-apart intervals at long chains 52. The rollers and/or roller supports may be attached to the chains in various ways, including for example by fasteners, adhesives, bonding, welding, etc. In one embodiment, the rollers 50 are metal wheels; however, other similar mechanisms and/or materials that can withstand heat (for example, up to approximately 250° C.) may also be used for the rollers.

In one embodiment, the rollers 50 are attached to chains 52 in such a manner that when the fitting 55 is at or near one end of the screen support 40, the rollers are on an upper surface of chains 52 for supporting substantially the full length of the screen above the screen support. As the drive mechanism drives the screen in the forward direction P, the rollers also move with the chains and, one by one, as the rollers reach the other end of the screen support, they disengage from screen and move with the chains peripherally around the sprockets 53 to a lower surface. As such, the screen support 40 is configured to provide sufficient clearance for the rollers to move therethrough on the lower surface of the chains.

When the driver engages the wellbore screen at one end, at least a portion of the outer diameter of the screening component is exposed.

The injector 42 handles the coating materials and operates to inject the coating material on to the outer tubular surface of the wellbore screen. The injector is preferably positioned adjacent to the support frame 41, with tip 57 pointing towards the frame. The coating material delivery line 56 extends through the elongate injector from the coating material supply 58 to tip 57. The delivery line 56 may be disposed inside an outer tubing 66.

Tip 57 is in communication with delivery line 56. Tip 57 may have one or more openings through which the coating material is extruded from the delivery line and introduced to the outer surface of the screen. In one embodiment, the tip 57 includes a plurality of openings arranged in a row. In a further embodiment, there are multiple rows of openings at the tip 57, and the positions of the openings in adjacent rows may be staggered or aligned.

In one embodiment, the coating material supply may be a tank, a hopper, etc. In the illustrated embodiment, the apparatus is selected to handle wax as a coating material and the coating material supply 58 includes a hopper for accepting a supply of solid wax and a wax extruder 60 including a heater to convert the wax to a substantially liquid form and an auger to force the liquefied wax into the injector's delivery line. In the illustrated embodiment, the flow direction of the coating material in the delivery line when the injector is in operation is indicated by an arrow C. Injector 42 may include a mechanism to help evenly distribute coating material among the openings at tip 57, such that the flow rate of coating material out of each of the openings is substantially the same.

Frame 41 has a proximal end 43 and a distal end 59. In the illustrated embodiment, the driver drives the wellbore screen toward the distal end 59, with the central long axis of the screen substantially parallel with the long axis of the frame, sliding a lower side of the outer tubular surface of the screen on to an upper surface of frame 41, for example as illustrated by a screen portion 2*a* in FIG. 2.

The frame 41 may be selected to have a length, from the distal end to the proximal end, that is substantially equal to the length of the portion of the screen to be coated. For example, in one embodiment, the screen may be over 100 feet long, with the screen component supported along almost that full length and the frame is at least that long.

In one embodiment, for example as illustrated in the Figures, the support frame 41 includes one or more rollers 63 on which the screen can be supported as the driver slides the screen on to the frame 41. The rollers 63 may be supported by roller supports. Preferably, the rollers form an upper surface of frame 41 that is substantially at the same height level as rollers 50, such that as the driver slides the screen on to frame 41, the screen can transition smoothly from the support frame 40 to support frame 41. When the screen is supported on frame 41, at least a portion of the outer surface of the roller is in contact with the outer tubular wall of the wellbore screen. The rollers 63 are configured to support both axial and rotational movements of the screen. The rollers 63 and/or roller supports may be attached to the support frame 41 in various ways, including for example by fasteners, adhesives, bonding, welding, etc.

In the illustrated embodiment, the rollers 63 are generally cylindrical in shape with an outer tubular surface and may be made of flexible and/or resilient materials such as for example, a sheet of spring steel, rubber, etc. In one embodiment, the rollers 63 are metal cylindrical members; however, other similar mechanisms and/or materials that can withstand heat (for example, up to approximately 250° C.) may also be used for the rollers.

The tip 57 is positioned relative to the support frame 41 so that the opening(s) at tip 57 from which coating material exits the tip is positioned sufficiently close to the outer tubular wall, when the screen is supported on rollers 63 of support frame 41, such that the coating material can easily be applied to the outer tubular wall without requiring the coating material to exit tip 57 at a high pressure. In one embodiment, the opening at tip 57 is spaced from the outer tubular wall by a distance of approximately 1/16"±1/64". If wax is the coating material, the wax may be ejected from tip 57 at a pressure ranging between 1 to 2000 psi. In one embodiment, the tip 57 points towards and is in close proximity to the interface between the outer surface of the screen and the outer surface of the roller 63, when the screen is supported by frame 41.

Preferably, the rollers 63 are positioned along the length of frame 41, on an upper surface and near one or both lengthwise sides thereof, with the central long axis of the rollers being substantially parallel to the long axis of the screen, when the screen is supported on frame 41. In a preferred embodiment, rollers 63 engages the outer tubular wall of the wellbore screen to help spread the coating material introduced from the tip 57 to the outer tubular wall of the wellbore screen and/or drive the coating material into the screening component.

In one embodiment, the roller 63 is a continuous cylindrical member positioned along substantially the entire length of frame 41. In another embodiment, rollers 63 are two or more spaced-apart cylindrical roller segments sharing the same central long axis that are positioned intermittently or continuously along substantially the entire length of frame 41. Rollers 63 are preferably positioned along substantially the entire length of frame 41, but not necessarily.

In the illustrated embodiment, one roller 63*a* is positioned along one lengthwise side of frame 41 and another roller 63*b* is positioned along the other lengthwise side of frame 41. The roller 63*a* on one side of frame 41 may be lined up with the roller 63*b* on the other side the frame 41, such that they are at about the same position along the length of frame 41. Alternatively, rollers 63*a* and 63*b* are aligned and their position along the length of frame 41 may be staggered. As mentioned above, rollers 63 may comprise of a plurality of roller segments, and the roller segments on one side of frame 41 may or may not be aligned with the roller segments on the other side. In one embodiment, the roller segments on either side of frame 41 are in a staggered configuration with the roller segments on the other side.

In one embodiment, roller 63 is rotatable about its long axis. The rotation of the rollers 63 may be active and/or passive. For example, the rollers may be rotated actively by one or more motors. Additionally or alternatively, the rollers may rotate by the frictional forces created by the physical engagement between the outer surface of the screen and the outer surface of the rollers 63, when the screen is rotated while being supported on the rollers 63.

In one embodiment, the position of injector 42 relative to frame 41 is substantially fixed during the operation of the apparatus. More specifically, injector 42 is stationary relative to the support frame 41 while the screen is moved in the axial direction relative to frame 41 on rollers 63. Further, injector 42 may be positioned anywhere along the length of frame 41, but injector 42 is preferably positioned near the proximal end 43 or distal end 59 of frame 41, with tip 57 pointing in the direction of the frame.

In another embodiment, injector 42 is movable relative to frame 41, in the axial direction of the frame (i.e. in the forward direction P and the reverse direction R). While the injector 42 moves in the axial direction, the lateral and vertical position of the tip 57 relative to the frame 41 preferably remains substantially the same. The injector may be moved in the axial direction by a driving mechanism. For example, to achieve axial movement of the injector 42, the injector 42 may be disposed on wheels that are drivable by a motor. Alternatively, injector 42 may be installed on a movable track (for example, a chain and sprocket mechanism driven by a motor) that runs substantially parallel to the long axis of frame 41 and injector 42 is moved in the axial direction by moving the track. In this embodiment, where injector 42 is movable in the axial direction, support frame 40 along with all its components (i.e. driver 54, fitting 55, chains 52, sprockets 53, etc.) may be omitted from the apparatus such that screen 2 can be placed on support frame 41 by other means without having the screen slidingly placed on to frame 41. In a further embodiment, where the injector 42 is movable axially relative to the frame 41, frame 41 may include a fitting having a rotator component (similar to fitting 55) that can be secured to one end of the screen for rotating same about its long central axis. Alternatively or additionally, the screen may be rotated about its long central axis by actively rotating rollers 63.

In another embodiment, the apparatus may include two or more injectors 42 disposed at various locations along the length of support frame 41, and the two or more injectors 42 may be stationary or movable relative to support frame 41 while the apparatus is in operation.

Alternatively or additionally, tip 57 is configured to be movable in the axial direction relative to frame 41, whether or not injector 42 is movable relative to frame 41. Preferably, when tip 57 moves in the axial direction, the lateral and vertical position of the tip 57 relative to the frame 41 remains substantially the same. However, the lateral and vertical position of tip 57 is preferably adjustable relative to frame 41 to accommodate screens of various sizes and outer diameters.

In one embodiment, the injector may include a heater (not shown) along the length of the delivery line to ensure the wax remains sufficiently liquid. The delivery line 56 may include an inner tubing 64 through which the wax moves and outer tubing 66 forms an annular space between the inner tubing and the outer tubing. Heaters, for example induction heaters, may be installed in the annular space and may be operated to maintain the wax at a selected temperature in the inner tubing sufficient to prevent the wax from hardening therein. In one embodiment, heaters line substantially the full length of delivery line 56.

In one embodiment, intended for use to inject wax or the like, the apparatus includes a heating element for heating the screen before and/or while the wax is injected thereon. For example, a substantially annular external heater may be positioned substantially concentrically about the screen when the screen is supported on frame 41. The external heater may be placed near at least a portion of the outer surface of the screen and can act to heat the screen from a position adjacent its outer surface. The external heater may be positioned adjacent to either or both sides of the injector 42. In one embodiment, the heating element is selectively movable axially relative to frame 41 such that the heating element can be placed at any axial location along the length of frame 41.

Figure 3:
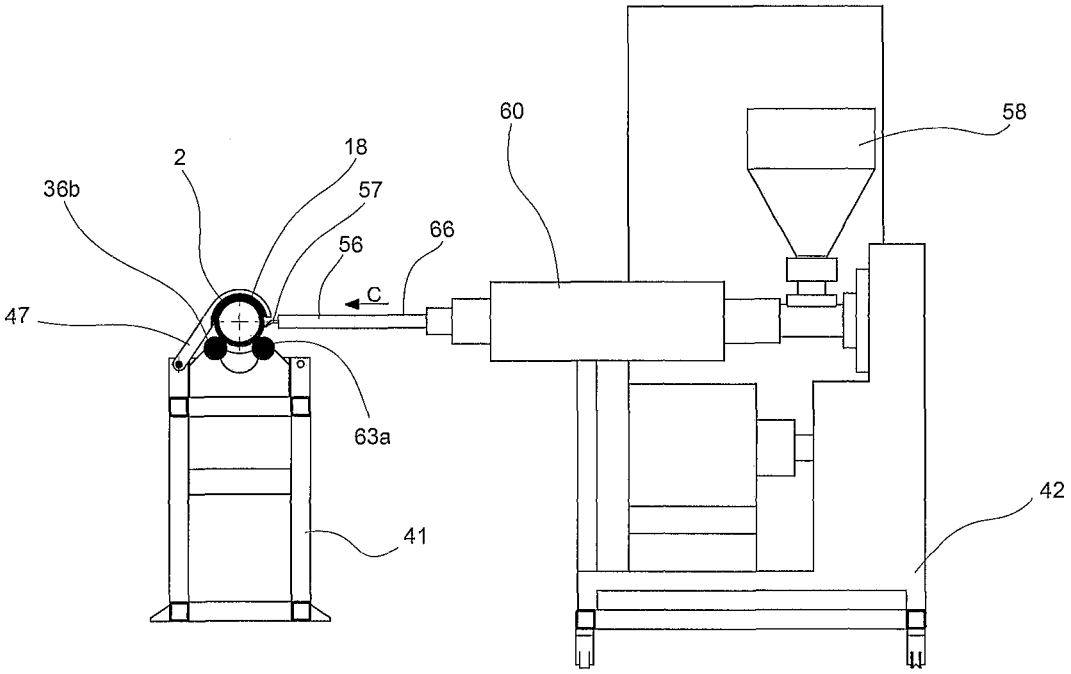
FIG. 3 is a cross-sectional view of the apparatus, along line AB-AB, in FIG. 2.
Figure 4:
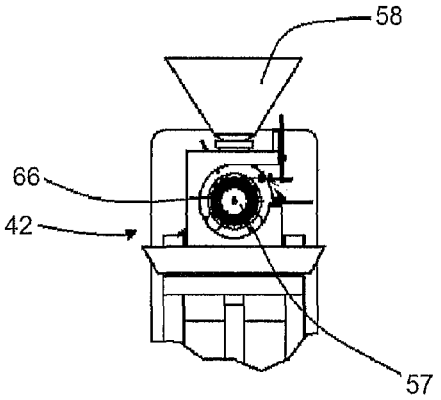
FIG. 4 is an end view of a portion of the injector of the apparatus.
Figure 5C:
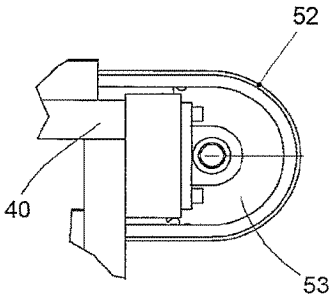
FIG. 5*c* is a magnified side view of the area V of FIG. 1.
Figure 5B:
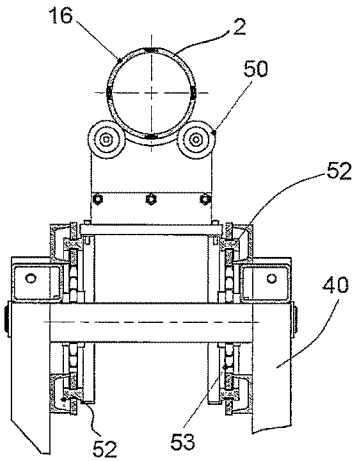
FIG. 5*b* is a cross-section of the support frame, on the left side of the apparatus of FIG. 1.
Figure 5E:
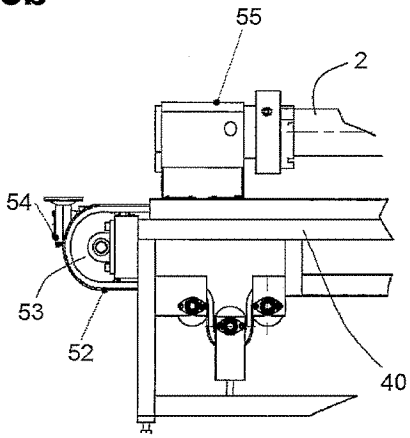
FIG. 5*e* is a magnified side view of the area T of FIG. 1.
Figure 5A:
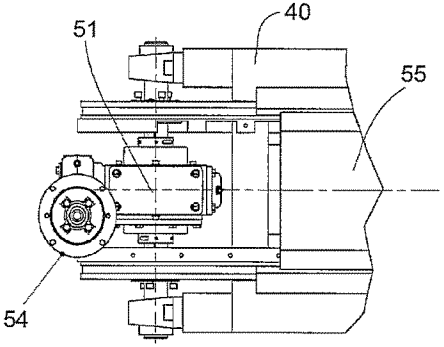
FIG. 5*a* is a magnified view of the area T of FIG. 1.
Figure 5D:
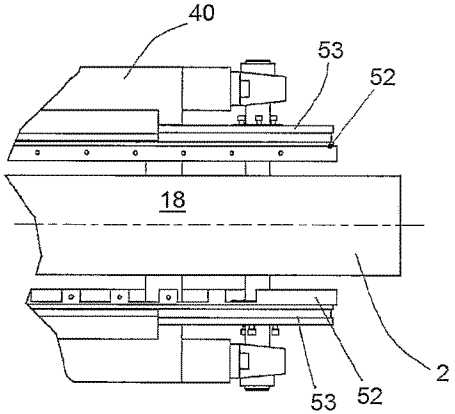
FIG. 5*d* is a magnified view of the area V of FIG. 1.

In another example, as shown in FIGS. 1 and 3, a heater is provided in the form of an arm 47 pivotably connected to frame 41, the arm having an inner surface with a heating element for placement adjacent to a portion of the outer surface of a length of the screen. The arm 47 is pivotable about an axis substantially parallel to the central long axis of the frame 41, such that the arm can be pivoted radially relative to the frame 41 to allow: (i) the arm to be raised to provide clearance when a portion 2*a* of the screen is first placed on to the frame 41; (ii) the arm to be selectively lowered to place the heating elements adjacent to a portion of the outer surface of a length of the screen that is on frame 41; and (iii) the arm to be raised or lowered to accommodate screens of various diameters. The arm 47 is placed somewhere along the length of frame 41, preferably at or near the location of tip 57 of injector 42. The heating element of the arm heats up the screen portion adjacent thereto and, as the screen is rotated, the heating element can substantially evenly heat the entire circumferential outer surface of a length of the screen.

The external heater may be selectively switched on or off. A section of the screen is preferably heated by the heating element before wax is injected thereon. For example, if the wax is to be distributed on to the outer tubular wall of the screen, while the screen moves in the forward axial direction on the support frame 41, as described in more detail hereinbelow, then the heating element should be positioned adjacent to the side of the injector 42 that is closer to the proximal end 43. If the wax is to be distributed on to the outer tubular wall while the screen moves in the reverse axial direction on the support frame 41, as described in more detail hereinbelow, then the heating element should be positioned adjacent to the side of the injector 42 that is closer to the distal end 59. If the wax is to be distributed on to the outer tubular wall during both the forward and reverse movement of the screen, then preferably a heating element is positioned adjacent each side of the injector 42 and is selectively turned on or off depending on the direction of movement of the screen relative to the support frame 41, such that the screen is heated before the injection of wax thereon.

If the apparatus includes an external heater, as noted above as an option, the screen can be heated from the outside and/or from the inside. By heating the screen, the surface can be prepared such that the wax does not immediately harden when it is injected thereon. The wax can therefore remain substantially liquid such that it can be spread and form a substantially continuous seal infiltrated to some degree into the screening component. For example, the external heater may be an induction heater, a resistance heater, or a combination thereof. The external heater can be controlled by thermocouples.

It can be appreciated that at least some of the parts of the apparatus can be removably attached, such that they may be replaced and/or removed for the purpose of maintenance and repairs.

The components of the apparatus, such as supports 40, 41, fitting 55, chains 52, arm 47, sprockets 53, inner tube 64, and outer tubing 66, are preferably made of materials that have sufficient structural integrity to support various loads and that can withstand high temperatures (for example, up to approximately 250° C.). In one embodiment, supports 40 and 41 are made of steel; fitting 55, chains 52, sprockets 53, arm 47, and inner tube 64 are made of stainless steel; and outer tubing 66 is made of aluminum. Other materials that have similar physical properties as those mentioned above may also be used in the apparatus.

In operation of the apparatus, a screen 2 can be installed on the driving base, supported by the rollers 50 and with the fitting secured to the screen such that the screen can be moved by the drive mechanism. The coating material can then be prepped for injection. Using wax, the coating material can be supplied as a solid and melted and prepared for injection to the screen. In the illustrated apparatus, the wax is melted on an as needed basis from the hopper through the wax extruder. The heaters in the elongate injector and the external heaters are operated to generate heat. The heaters along the delivery line are operated as necessary to maintain the liquid state of the coating material in the delivery line.

The driver is then operated to slidingly move the screen on to support frame 41. If the external heater is included, the external heater is positioned relative to the frame 41 to provide sufficient clearance for the screen to pass thereby or therethrough, and to rotate about its central long axis, but the external heater is also positioned close enough to the outer surface of the screen to allow heat from its heating elements to be transmitted to the screen. For example, if the external heater is the pivotable arm 47, the arm may be raised before the driver moves the screen on to frame 41. When the screen reaches or passes the axial location of the arm, the arm is lowered until the heating elements are close to but not touching the outer surface of the screen.

In one embodiment, where the injector is stationary and positioned near the proximal end of frame 41, as the screen moves on to support frame 41 in the forward direction P, the screen itself is heated as it moves past the external heater and is injected with coating material from tip 57 on to its outer tubular wall as the screening component moves past the tip 57. Alternatively or additionally, as the screen is moved in the reverse direction R from frame 41 to frame 40, the screen is heated as it moves past the external heater and is injected with coating material from tip 57 on to its outer tubular wall as the screen component moves past the tip 57.

In one embodiment, regardless of whether the coating material is injected on to the screen while the screen is moving in the forward P and/or reverse R direction, the screen is rotated by fitting 55 as it moves relative to frame 41, such that the coating material can be injected circumferentially on to the outer tubular wall of the screen. The rotation of the screen on support frame 41 may cause one or more rollers 63 to rotate passively, as a result of the frictional engagement between the outer surface of the rollers and the screen. The direction of rotation of the rollers is opposite that of the screen.

Alternatively or additionally, at least one of the rollers 63 actively rotates the screen while the screen is supported thereon. The direction of rotation of the actively rotating roller(s) is selected to be the opposite of the desired direction of rotation of the screen. Any non-actively rotating rollers 63 may rotate passively as a result of the rotation of the screen.

In an alternative embodiment, support frame 40 and the components thereon are omitted, and at least a portion of the screen is placed on support frame 41 at the start of the coating process. The screen is rotated about its central long axis by one or more actively-rotating rollers 63 (or by a fitting having a rotator component attached to one end of the screen), but the screen is substantially stationary axially relative to the support frame 41. Any non-actively rotating rollers 63 may rotate passively as a result of the rotation of the screen. In this embodiment, the injector 42 moves axially along the length of the support frame 41 from at least the start of the screening component of the screen to at least the end of the screening component, while injecting coating material on to the outer tubular surface of the screen. The axial movement of the injector allows coating material to be injected on to at least the entire length of the screening component, and the rotation of the screen, whether by the actively-rotating roller(s) or the fitting, allows coating material to be injected on to the outer tubular wall around the circumference thereof. If an external heater is included, the external heater may be configured to be movable axially relative to frame 41 at substantially the same speed as the injector, such that the external heater can heat the screen before or while coating material is injected on to the screen. The external heater may be configured to be movable relative to the frame 41 in the same or similar manner as the injector, examples of which are described above.

Whether the screen moves axially while injector 42 (and tip 57) remains stationary, or vice versa, once the tip 57 reaches where the screening components to be coated begin, the coating material is introduced from the opening(s) at tip 57 and is injected on to the outer wall. Simultaneously, the screen (or the injector) is moved in the forward direction P (or the reverse direction R) such that the injector continues to move relative to the screen as the coating material is injected along a length of the screen.

In addition to injection, the coating material may be further distributed on to the outer tubular wall by the rollers 63. Additionally, excess coating material may be scraped from the outer surface and/or inner wall of the screen. Once a desired length of the outer tubular wall has been coated with coating material, the injection of coating material from tip 57 is stopped and the screen (or injector) may be moved in the opposite direction, for example to remove the screen from support frame 41. In a further embodiment, the injector injects additional coating material over the previously coated section of the screen while the screen (or injector) moves in the opposite direction. Alternatively, the outer surface of the screen is only injected with coating material while the screen (or injector) moves in the opposite direction.

Further, as coating material is applied on to the screen, the screen is rotated about its long axis by either or both of a fitting (i.e. fitting 55 on frame 40 or a fitting on frame 41) and one or more rollers 63. Whether achieved by the rotation of the fitting and/or one or more of rollers 63, rotating the screen helps distribute the coating material circumferentially around the outer tubular surface. Further, the engagement between the outer surface of the rollers and the outer tubular surface of the screen helps spread the coating material introduced from injector 42 over the outer tubular wall and drive some of the coating material into the screening component.

In one embodiment, the apparatus includes a mechanism for scraping off excess coating material from the inner wall and/or outer surface of the screen.

The conditions of the coating materials and receiving surface of the screen and speed of screen movement and rotation are selected to ensure proper placement and set up of the coating material. More specifically, the speed of rotation of the fitting (i.e. fitting 55 on frame 40 or a fitting on frame 41) and/or one or more rollers 63, and the speed at which fitting 55 moves axially or injector 42 and external heater move axially, whichever is applicable, relative to support frame 41, and the number of times the screening component moves past tip 57, are selected to allow the screening component to be substantially covered with coating material. The speed of rotation of the fitting (i.e. fitting 55 on frame 40 or a fitting on frame 41) and/or one or more rollers 63 may also be selected to help reduce pooling and loss of coating material by gravity. In a further embodiment, using wax, the temperatures of the wax and screen are selected to avoid the wax from dripping directly into the screen and to avoid the wax from immediately setting up (before it can be spread and/or driven into the screening components) and the speed of moving and rotating the screen relative to the tip 57 are selected with consideration of the foregoing.

Wellbore screens can take many forms. As noted above, in one form of a wellbore screen the wall of the screen is substantially entirely formed of screening component. The wall includes screen material held between end fittings. The screen material may take various forms and is usually supported in some way, as by a perforated sleeve. These screens filter fluids passing through the screen material layer either into or out of the screen inner bore.

In another form, the one termed the cartridge-type screen, the wall of the screen is a base pipe that has a plurality of discreet filter cartridges supported therein. The filter cartridges are mounted in openings through the base pipe that forms the wall. The filter cartridges screen fluids passing through the openings into the base pipe for pumping or flow up hole. Of course, the openings may be formed and/or employed to also permit flow of fluids outwardly therethrough from the inner diameter of the base pipe.

Figure 6:
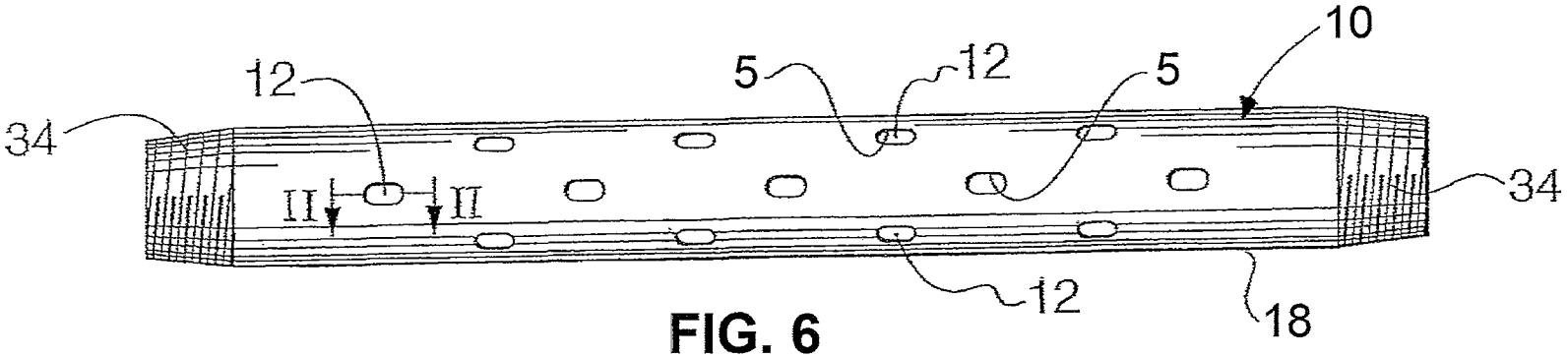
FIG. 6 is a side elevation of one wellbore tubular useful in the present invention.
Figure 7:
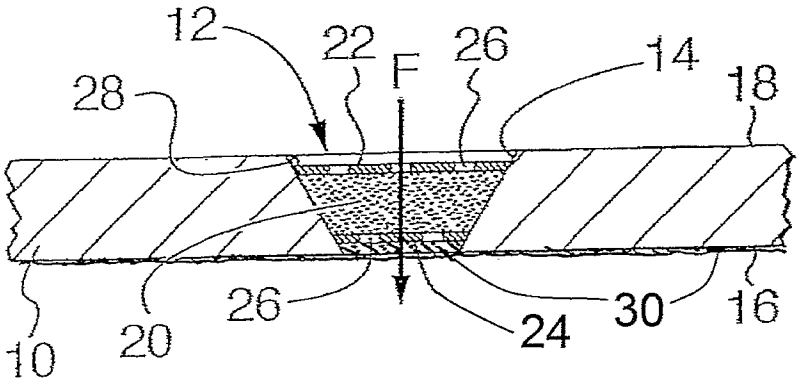
FIG. 7 is a section along line II-II of FIG. 6.

While the wellbore screen treated in the present invention can take many forms, one type of wellbore screen is disclosed here for clarity. Referring to FIGS. 6 and 7, a wellbore screen is shown including a perforated wall with fluid passages therethrough, which is illustrative of a cartridge-type screen. A cartridge-type screen includes a base pipe 10 including substantially circular such as circular or ovoid openings 5 that extend from the base pipe inner bore surface 16 to the base pipe outer surface 18 and a filter cartridge 12 is supported in each opening. Such a screen is durable and is useful in various wellbores operations such as those for water production, water/steam injection, oil and/or gas production, etc. The filter cartridges permit fluid flow through the openings into or out of the base pipe, but the integrity of the base pipe provides the screen with increased durability and strength not achievable in screens with walls entirely formed of screening components.

The filter cartridge 12 useful in a wellbore screen can include a filter media 20. In one embodiment, the filter cartridge can also include one or more retainer plates positioned about the filter media. In one embodiment, as illustrated, the filter cartridge includes an exterior retainer plate 22, an interior retainer plate 24 and filter media 20 contained therebetween. In one embodiment, the exterior retainer plate and the interior retainer plate may be coupled to one another by any of a plurality of methods, such as adhesives, welding, screws, bolts, plastic deformation and so on. In another embodiment, the retainer plates are not secured together but held in position by their mounting in the base pipe.

If used, the exterior retainer plate and the interior retainer plate may contain one or more apertures 26 through which fluid may flow, arrow F. Exterior retainer plate 22 and interior retainer plate 24 may be constructed of any suitable material, such as plastic, aluminum, steel, ceramic, and so on, with consideration as to the conditions in which they must operate.

Filter media 20 of the filter cartridge can be any media, such as including a layer of compressed fiber, woven media, ceramic and/or sinter disk that is capable of operating in wellbore conditions. The filter media must be permeable to selected fluids such as one or more of steam, stimulation fluids, oil and/or gas, while able to exclude oversized solid matter, such as sediments, sand or rock particles. Of course, certain solids may be permitted to pass, as they do not present a difficulty to the wellbore operation. Filter media can be selected to exclude particles greater than a selected size, as desired. The present screen can employ one or more layers or types of filter media. In one embodiment, a filter media including an inner woven screen, an outer woven screen and a fibrous material is used. In another embodiment, a filter cartridge may include a single layer of filter media, as shown in FIG. 7, to facilitate manufacture. Sintered material may be useful as a single layer filter media.

Openings 5 may be spaced apart on the base pipe wall such that there are chambers of solid wall therebetween. The openings extend through the base pipe sidewall and may each be capable of accommodating a filter cartridge 12. The filter cartridges can be mounted in the openings by various methods including welding, threading, etc. In one embodiment, at least some filter cartridges may be installed by taper lock fit into the openings. In such an embodiment, each of the filter cartridge and the opening into which it is to be installed may be substantially oppositely tapered along their depth so that a taper lock fit can be achieved. For example, the effective diameter of the opening adjacent the base pipe's outer surface 18 may be greater than the effective diameter of the opening adjacent inner bore surface 16 and cartridge 12 inner end effective diameter, as would be measured across plate 24 in the illustrated embodiment, may be less than the effective diameter at the outer end of filter cartridge 12 and greater than the opening effective diameter adjacent inner bore surface 16, so that the filter cartridge may be urged into a taper lock arrangement in the opening. In particular, the outer diameter of the filter cartridge can be tapered to form a frustoconical (as shown), frustopyramidal, etc. shape and this can be fit into the opening, which is reversibly and substantially correspondingly shaped to engage the filter cartridge when it is fit therein. In one embodiment for example, the exterior retainer plate may exceed the diameter of the interior retainer plate of the filter cartridge. Of course, the filter cartridge may be tapered from its inner surface to its outer surface in a configuration that is frustoconical, frustopyramidal, and so on and the openings of the base pipe may be tapered correspondingly so that their diameter adjacent the inner bore surface is greater than that adjacent the side wall outer surface, if desired. However, installation may be facilitated by use of an inwardly directed taper, as this permits the filter cartridges to be installed from the base pipe outer surface and forced inwardly.

The filter cartridges may be secured in the base pipe openings by any of various means. For example, in one embodiment, the filter cartridge may be press-fit into the opening of the base pipe. In another embodiment, the filter cartridge may be secured to the opening of the base pipe by an adhesive 28 (for example epoxy), by welding, by soldering, by plastic deformation of the base pipe over the cartridge, by holding or forcing the cartridge into engagement behind a retainer or extension over of the opening and so on, at one or more of the interface points between the filter cartridge and the base pipe. A seal, such as an o-ring, may be provided between the filter cartridge and the opening, if desired.

In a wellbore screen, as shown, the coating applied by the apparatus and method may form a selectively openable impermeable layer 30 relative to at least some of the plurality of openings. The impermeable layer can be normally closed and when closed is impermeable to solid matter as well as substantially impermeable to fluid flow, such as any or all of wellbore fluids, drilling fluids, injection fluids, etc.

Impermeable layer 30, however, can be selectively opened at a selected time, such as when the screen is in a selected position downhole, such as when it is in a finally installed position.

The impermeable layer may act at one or a plurality of openings to plug fluid flow therethrough. As described above, the impermeable layer will be positioned to infiltrate into filter media 20 from the inner diameter side. The impermeable layer may serve to cover/block/plug the openings and the filter cartridge in order to prevent the flow of fluid therethrough and/or to prevent access of solids to the filter media, until the impermeable layers are selectively opened.

The impermeable layer may be opened to permit fluid flow once the wellbore screen is in position down hole. The method of opening can vary based on the material of the impermeable layer, and may include pressure bursting and/or removal by solubilization, melting, etc. as by acid, caustic or solvent circulation, temperature sensitive degradation, and so on.

In one application, a wellbore screen including impermeable layers relative to its openings, may be useful to increase buoyancy of the screen during installation, which is useful in horizontal installations. The impermeable layer also resists plugging of the openings, which can result for example from the rigors of running in. In another application, the impermeable layers are used to selectively allow flow along or from a certain section of the wellbore, while flow is blocked through other openings. In yet another application, a wellbore screen including impermeable layers relative to its openings, may be useful to allow fluid circulation through the screen during run in, which reduces hole stuck and cave in problems. Removable layers in the screening components also permit drilling of the screen into the hole, as by liner drilling. In such an application, the impermeable layers can be selected to hold the pressures encountered during drilling, for example, pressures of a few hundred psi. In such an embodiment, the impermeable layers will be present to plug the openings at least when the wellbore screen is being run down hole so that the wellbore screen may be drilled directly into the hole. Once the screen is drilled into position, the impermeable layers may be opened, as by residence time at wellbore conditions, circulating fluids to breakdown and remove the coating material (i.e. circulating heated fluids to melt the coating material) or bursting with application of fluid pressure above that which the layers can hold.

Depending on the application, it may be useful to seal all of the openings of a wellbore screen or it may be useful to block only certain of the openings, while others are left open. In another embodiment, it may be useful to use selected materials to form the impermeable layers on a first group of openings while another impermeable layer material is used over the openings of a second group so that some openings within a liner, for example those of the first group, can be opened while others, for example the openings of the second group, remain closed until it is desired to remove or break open that impermeable material.

One or more impermeable layers can be used, as desired. The layers may be positioned to provide protection to certain filter cartridge components.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. For US patent properties, it is noted that no claim element is to be construed under the provisions of 35 USC 112, sixth paragraph, unless the element is expressly recited using the phrase "means for" or "step for".

I claim:

1. An apparatus for treating a wellbore screen with a coating material, the apparatus comprising: a support for supporting an outer tubular wall of the wellbore screen; a support frame; an injector for injecting coating material on to the outer tubular wall of the wellbore screen; a coating material delivery line extending through the injector from a coating material supply to an injection tip positioned near the support frame; a driver for positioning the wellbore screen relative to the support frame and injection tip, and for moving the wellbore screen axially along the support frame to allow the injector to distribute coating material on to the outer tubular wall of the wellbore screen via the injection tip; and, a heating element for heating the wellbore screen, wherein the heating element is a substantially annular external heater positioned on or near the support frame for substantially concentric alignment about the wellbore screen, and wherein the heating element is disposed in an inner surface of an arm pivotably connected to the support frame, and one or more of the direction relative to the support frame, angle relative to the support frame, and distance from the support frame of the inner surface, is selectively adjustable by pivoting the arm relative to the support frame.

2. The apparatus of claim 1, wherein the driver comprises a drive mechanism comprising a fitting for engaging one end of the wellbore screen.

3. The apparatus of claim 2, wherein the drive mechanism further comprises a motor, a sprocket, and a chain or a belt, and the chain or belt is meshed with the sprocket, rotational movement of which is controlled by the motor.

4. The apparatus of claim 3, wherein the fitting is connected to the chain or belt such that the fitting is moved along a long axis of the support frame from the rotational movement of the sprocket.

5. The apparatus of claim 4, wherein the fitting comprises a rotator component for rotating the wellbore screen about its long axis.

6. The apparatus of claim 1, wherein the coating material supply comprises an extruder and an auger for delivering the coating material into the delivery line.

7. The apparatus of claim 1, wherein the injection tip includes one or more openings for allowing passage of the coating material therethrough.

8. The apparatus of claim 7, wherein the injector includes a mechanism for evenly distributing coating material among the one or more openings.

9. The apparatus of claim 1, wherein the support frame comprises one or more rollers for supporting the wellbore screen thereon and for supporting any axial and/or rotational movements of the wellbore screen.

10. The apparatus of claim 9, wherein the injection tip is positioned near an outer surface of one of the one or more rollers.

11. The apparatus of claim 9, wherein the one or more rollers are positioned along the length of the support frame for engaging the outer tubular wall of the wellbore screen to help: spread the coating material on the outer tubular wall; or drive the coating material into a screening component of the wellbore screen.

12. The apparatus of claim 9, wherein the one or more rollers comprise one or more cylindrical members.

13. The apparatus of claim 9, wherein the one or more rollers are rotatable about their long central axis and the rotation of the one or more rollers is one or both of active and passive.

14. The apparatus of claim 1, wherein (i) the injector, (ii) the injection tip, or (iii) both, are stationary relative to the support frame.

15. The apparatus of claim 1, wherein (i) the injector, (ii) the injection tip, or (iii) both, are movable relative to the support frame.

16. The apparatus of claim 1, wherein the delivery line comprises an inner tubing and an outer tubing, and an annulus is formed between an outer surface of the inner tubing and an inner surface of the outer tubing, and further comprising a heater disposed in the annulus for heating the delivery line.

17. An apparatus for treating a wellbore screen with a coating material, the apparatus comprising: a support for supporting an outer tubular wall of the wellbore screen; an injector for injecting coating material on to the outer tubular wall of the wellbore screen via an injection tip positioned near the support; a coating material delivery line extending through the injector from a coating material supply to the injection tip; and a driving mechanism for moving the injection tip axially relative to the support in a direction substantially parallel to a lengthwise axis of the support, to allow the injector to distribute coating material on to the outer tubular wall of the wellbore screen via the injection tip; and a heating element for heating the wellbore screen, wherein the heating element is movable axially relative to the support in the direction substantially parallel to the lengthwise axis of the support.

18. The apparatus of claim 17, wherein the driving mechanism comprises wheels having the injector installed thereon and a motor for driving the wheels for moving the injection tip along with the injector.

19. The apparatus of claim 17, wherein the driving mechanism comprises a movable track having the injector installed thereon, the movable track running substantially parallel to the lengthwise axis of the support, and the injector is moved axially by movement of the movable track.

20. The apparatus of claim 17, further comprising a fitting for engaging a part of the wellbore screen and the fitting comprises a rotator component for rotating the wellbore screen about its long axis.

21. The apparatus of claim 17, wherein the coating material supply comprises an extruder and an auger for delivering the coating material into the delivery line.

22. The apparatus of claim 17, wherein the injection tip includes one or more openings for allowing passage of the coating material therethrough and wherein the injector includes a mechanism for evenly distributing coating material among the one or more openings.

23. The apparatus of claim 17, wherein the support comprises one or more rollers for supporting the wellbore screen thereon and for supporting any axial and/or rotational movements of the wellbore screen and wherein the injection tip is positioned near an outer surface of one of the one or more rollers.

24. The apparatus of claim 17, wherein the support comprises one or more rollers for supporting the wellbore screen thereon and for supporting any axial and/or rotational movements of the wellbore screen and wherein the one or more rollers are positioned along the length of the support for engaging the outer tubular wall of the wellbore screen to help: spread the coating material on the outer tubular wall; or drive the coating material into a screening component of the wellbore screen.

25. The apparatus of claim 17, wherein the support comprises one or more rollers for supporting the wellbore screen thereon and for supporting any axial and/or rotational movements of the wellbore screen and wherein the one or more rollers are rotatable about their long central axis and the rotation of the one or more rollers is one or both of active and passive.

26. The apparatus of claim 17, wherein the injection tip is stationary relative to the injector.

27. The apparatus of claim 17, wherein the injection tip is movable relative to the injector.

28. The apparatus of claim 17, wherein the delivery line comprises an inner tubing and an outer tubing, and an annulus is formed between an outer surface of the inner tubing and an inner surface of the outer tubing, and further comprising a heater disposed in the annulus for heating the delivery line.

29. The apparatus of claim 17, wherein the heating element is a substantially annular external heater positioned on or near the support frame for substantially concentric alignment about the wellbore screen.

30. A method for treating a wellbore screen having a tubular wall with an outer tubular surface and a screening component installed to screen fluid passing through the tubular wall from the outer tubular surface to the inner bore, the method comprising: providing the apparatus of claim 17; supporting at least a portion of the wellbore screen on the support frame; introducing the coating material in the form of a liquid on to the outer tubular surface via the injection tip of the injector; distributing the coating material on to the outer tubular surface such that the coating material penetrates to some extent into the screening component; and allowing the coating material to set to form a removable seal across the screening component in the outer diameter.

31. The method of claim 30 further comprising rotating the wellbore screen during the introduction of the coating material.

32. The method of claim 31 further comprising moving the wellbore screen axially relative to the support frame while or after rotating the wellbore screen.

33. The method of claim 32, wherein moving the wellbore screen is performed by the driving mechanism and the drive mechanism engages an end of the wellbore screen.

34. The method of claim 31 further comprising moving the injection tip axially relative to the wellbore screen while or after rotating the wellbore screen.

35. The method of claim 32, wherein distributing includes spreading the coating material using one or more rollers supported on the support frame.

36. The method of claim 32 further comprising scraping excess coating material from a surface of the wellbore screen.

37. The method of claim 32 further comprising heating at least a portion of the wellbore screen before or during the introduction of the coating material.

38. The method of claim 30 further comprising supplying the coating material to the injection tip from the coating material supply via the coating material delivery line extending through the injector.

39. The method of claim 38 further comprising heating at least a portion of the delivery line.

40. The method of claim 31 wherein the rotation of the wellbore screen is performed by the driving mechanism or by one or more rollers supported on the support frame.

* * * * *